US011548047B2

(12) United States Patent
Irving

(10) Patent No.: US 11,548,047 B2
(45) Date of Patent: Jan. 10, 2023

(54) FENCE POST STRAIGHTENING DEVICE

(71) Applicant: DJI INNOVATIONS PTY LTD, Mudgee (AU)

(72) Inventor: Daryl Irving, Mudgee (AU)

(73) Assignee: DJI INNOVATIONS PTY LTD, Mudgee (AU)

( * ) Notice: Subject to any disclaimer, the term of this patent is extended or adjusted under 35 U.S.C. 154(b) by 1 day.

(21) Appl. No.: 16/349,604

(22) PCT Filed: Nov. 15, 2017

(86) PCT No.: PCT/AU2017/000241

§ 371 (c)(1),
(2) Date: May 13, 2019

(87) PCT Pub. No.: WO2018/090074

PCT Pub. Date: May 24, 2018

(65) Prior Publication Data

US 2019/0275577 A1 Sep. 12, 2019

(30) Foreign Application Priority Data

Nov. 15, 2016 (AU) ..... 2016904663

(51) Int. Cl.
*B21D 3/05* (2006.01)
*B21D 3/14* (2006.01)

(52) U.S. Cl.
CPC ..... *B21D 3/05* (2013.01); *B21D 3/14* (2013.01)

(58) Field of Classification Search
CPC ... B21D 3/05; B21D 3/14; B21D 5/14; B21D 5/08; B21D 3/00; B21D 3/02; B21B 1/092; B21F 1/02
(Continued)

(56) References Cited

U.S. PATENT DOCUMENTS 731,675 A * 6/1903 Geyer ..... B21D 3/05 72/162
2,279,038 A * 4/1942 Gifford ..... B21D 7/08 72/162

(Continued)

FOREIGN PATENT DOCUMENTS

CN 2576371 Y 10/2003
CN 1820868 A 8/2006

(Continued)

OTHER PUBLICATIONS

Machine translation of first Chinese Office Action dated Apr. 13, 2020 for Chinese patent application No. 201780076723.1, 29 pages.

(Continued)

*Primary Examiner* — Edward T Tolan
(74) *Attorney, Agent, or Firm* — Lee & Hayes, P.C.

(57) ABSTRACT

A three blade fence post straightening device comprises a first row of at least three rollers and a second row of at least three rollers. An axis of rotation of each of the rollers in the first row may be substantially parallel to each other and an axis of rotation of each of the rollers in the second row may be substantially parallel to each other. A forming profile defined between outer surfaces of the respective rollers of each pair of rollers may substantially correspond to a cross section of a three blade fence post, with forming profiles of each pair of rollers being longitudinally aligned to form a substantially straight path through the straightening device. A drive means may be configured to drive each of the rollers in the first row and/or the second row.

30 Claims, 12 Drawing Sheets

(58) Field of Classification Search
USPC ..... 72/181, 179, 160
See application file for complete search history.

(56) References Cited

U.S. PATENT DOCUMENTS

| | | | | | |
|---|---|---|---|---|---|
| 4,022,046 | A | | 5/1977 | Serizawa et al. | |
| 4,055,981 | A | * | 11/1977 | Olson | B21D 1/10 72/415 |
| 5,400,631 | A | | 3/1995 | Benedetti et al. | |

FOREIGN PATENT DOCUMENTS

| | | | | | |
|---|---|---|---|---|---|
| CN | 101085457 | A | | 12/2007 | |
| CN | 201217023 | Y | | 4/2009 | |
| CN | 201217023 | Y | * | 4/2009 | |
| CN | 101559451 | A | | 10/2009 | |
| CN | 201446158 | U | | 5/2010 | |
| CN | 201880759 | U | | 6/2011 | |
| CN | 202316675 | U | | 7/2012 | |
| CN | 204035250 | U | | 12/2014 | |
| CN | 204247758 | U | | 4/2015 | |
| CN | 204307981 | U | | 5/2015 | |
| CN | 105312361 | A | | 2/2016 | |
| CN | 205587462 | U | | 9/2016 | |
| CN | 205613986 | U | | 10/2016 | |
| CN | 106077163 | A | * | 11/2016 | |
| CN | 106734386 | A | * | 5/2017 | |
| DE | 322666 | C | | 7/1920 | |
| DE | 330957 | C | | 12/1920 | |
| EP | 2949407 | A1 | * | 12/2015 | B21F 1/02 |
| JP | 55-70418 | A | * | 5/1980 | B21D 3/05 |
| JP | 61-115620 | A | * | 6/1986 | B21D 3/05 |
| WO | 2012/174606 | A1 | * | 12/2012 | B21B 1/08 |

OTHER PUBLICATIONS

The International Publication No. PCT/AU2017/000241 and PCT Search Report published May 24, 2018, 35 pages.

* cited by examiner

FENCE POST STRAIGHTENING DEVICE

This application is a national stage application of an international patent application PCT/AU2017/000241, filed Nov. 15, 2017, which claims priority to Australian Patent Application No. 2016904663, filed on Nov. 15, 2016, entitled "Fence post straightening device," which applications are hereby incorporated by reference in their entirety.

FIELD

The present invention relates to a fence post straightening device, and especially a fence post straightening device for three blade fence posts.

BACKGROUND

Three blade "star posts" are a form of fence post that are typically used to support wire or mesh fencing. Three blade star posts are made of steel and have a generally "Y" or "T" shaped cross-section.

Fences often extend significant distances. Fencing maintenance requires replacing any bent or otherwise damaged star posts with new. Bent star posts typically cannot be manually straightened and are therefore discarded. It is common for properties, particularly farms, to have large piles of damaged star posts that are simply left to rust.

SUMMARY OF INVENTION

According to a first aspect, the present invention provides a fence post straightening device for straightening a fence post having three blades extending longitudinally of the post, each of which blades projects radially from a longitudinal axis of the post, the fence post straightening device comprising at least one first roller presenting a first outer surface and arranged for rotation about an axis thereof;

at least one second roller presenting a second outer surface and arranged for rotation about an axis thereof substantially parallel to the axis of the at least one first roller;

wherein each said at least one first roller is arranged in opposed relationship with a respective said at least one second roller to form an opposed roller pair, and wherein the first outer surface and the second outer surface of each roller pair together define a forming profile there-between corresponding to a cross-section of the fence post; and drive means configured to drive the at least one first roller and/or the at least one second roller in rotation about its respective axis such that, in use, the fence post is conveyed longitudinally through the forming profile of each opposed roller pair to forcibly remove any bend in the fence post and to substantially conform the fence post to the forming profile.

In a preferred form, the at least one first roller comprises two first rollers arranged spaced apart in a first row and with their respective rotational axes substantially parallel, the at least one second roller comprises two second rollers arranged spaced apart in a second row and with their respective rotational axes substantially parallel, and the first and second rollers are arranged to form two opposed roller pairs.

In a preferred form, the at least one first roller comprises three first rollers arranged spaced apart in a first row and with their respective rotational axes substantially parallel to one another, the at least one second roller comprises three second rollers arranged spaced apart in a second row and with their respective rotational axes substantially parallel to one another, and the first and second rollers are arranged to form three opposed roller pairs.

In a preferred form, the forming profiles of the opposed roller pairs are substantially aligned to form a substantially straight path through the straightening device.

In a preferred form, the outer surface of the first roller in each opposed roller pair has or includes a circumferential protrusion that, in use, is received between two of the blades of the fence post.

In a preferred form, the outer surface of the second roller in each opposed roller pair has or includes a circumferential recess into which the circumferential protrusion of the outer surface of the first roller extends in the forming profile. The circumferential recess divides the second roller into two parts and, in use, receives one of the blades of the fence post.

In a preferred form, the outer surface of the second roller in the recess includes an angled or sloping surface on each of the two roller parts that, in use, abuts a respective blade of the fence post in the forming profile.

In a preferred form, the forming profile of each opposed roller pair is substantially "Y"-shaped.

According to a second aspect, the present invention provides a three blade fence post straightening device comprising:

a first row of at least three rollers, an axis of rotation of each of the rollers in the first row being substantially parallel to each other;

a second row of at least three rollers, an axis of rotation of each of the rollers in the second row being substantially parallel to each other, the second row being disposed such that the rollers of the first and second rows oppose each other and form at least three respective pairs of rollers, with each pair of rollers comprising one of the rollers of the first row and a respective roller of the second row;

a forming profile defined between outer surfaces of the respective rollers of each pair of rollers, the forming profile of each pair of rollers substantially corresponding to a cross section of a three blade star post, with the forming profiles of each pair of rollers being longitudinally aligned to form a substantially straight path through the straightening device; and a drive means configured to drive each of the rollers in the first row and/or the second row, wherein, in use, the driven rollers convey the three blade star post longitudinally through the substantially straight path, and the pairs of rollers forcibly remove any bends in the three blade star post to substantially conform the three blade star post to the substantially straight path as the three blade star post is conveyed through the substantially straight path.

In a preferred form, a protrusion extends circumferentially around the outer surface of each of the rollers in the first row, and each of the protrusions, in use, are adapted to be received between two of the three blades of the three blade fence post.

In a preferred form, a recess extends circumferentially around the outer surface of each of the rollers in the second row, each recess divides a respective roller in the second row into a first roller part and a second roller part, and each of the recesses, in use, are adapted to receive one of the three blades of the three blade fence post.

In a preferred form, the first roller part and the second roller part of each roller in the second row have a taper that tapers toward the recess, and, in use, the respective tapers of each roller in the second row are adapted to abut a respective blade of the three blade fence post.

In a preferred form, the forming profiles of each pair of rollers has a substantially "Y" shaped profile.

In a preferred form, the axis of rotation of each roller in a respective pair of rollers are parallel and aligned in a direction substantially perpendicular to the substantially straight path.

In a preferred form, the axis of rotation of each roller in the first row is parallel to the axis of rotation of each roller in the second row.

In a preferred form, the drive means is configured to drive each of the rollers in the first row or each of the rollers in the second row.

In a preferred form, the drive means is configured to drive each of the rollers in the first row and each of the rollers in the second row.

In a preferred form, each of the driven rollers has an associated active gear wheel, and the three blade fence post straightening device further comprises an active drivetrain coupled to the drive means and each active gear wheel.

In a preferred form, the active drivetrain is a chain.

In a preferred form, each of the non-driven rollers has an associated passive gear wheel, and the three blade fence post straightening device further comprises a passive drivetrain coupled to each passive gear wheel.

In a preferred form, the passive drivetrain is a chain.

In a preferred form, the drive means is a hydraulic motor.

In a preferred form, the drive means is an electric motor.

In a preferred form, the first row of rollers has four rollers and the second row of rollers has four rollers, thereby forming four respective pairs of rollers.

In a preferred form, the first row is disposed above the second row, and the first row is biased toward the second row by gravity.

In a preferred form, the three blade fence post straightening device further comprises one or more springs extending between the first row and the second row, wherein the one or more springs are configured to bias the first row and second row towards each other.

In a preferred form, the three blade fence post straightening device is mounted to a vehicle.

According to a third aspect, the present invention provides a method of straightening a three blade fence post, the method comprising:

providing a first row of at least three rollers, an axis of rotation of each roller in the first row being substantially parallel to each other;

providing a second row of at least three rollers, an axis of rotation of each roller in the second row being substantially parallel to each other;

disposing the second row such that the second row opposes the first row and forms at least three respective pairs of rollers, each pair of rollers comprising one of the rollers in the first row and a respective roller in the second row, wherein outer surfaces of the respective rollers of each pair of rollers define a forming profile, the forming profiles of each pair of rollers substantially correspond to a cross section of a three blade fence post, with the forming profiles of each pair of rollers being longitudinally aligned to form a substantially straight path, the substantially straight path having a first end and a longitudinally opposed second end;

energising a drive means configured to drive each of the rollers in the first row and/or the second row;

inserting the three blade fence post into the first end of the substantially straight path, wherein the driven rollers convey the three blade fence post longitudinally through the substantially straight path towards the second end, and the pairs of rollers forcibly remove any bends in the three blade fence post to substantially conform the three blade fence post to the substantially straight path as the three blade fence post is conveyed through the substantially straight path.

In a preferred form, four rollers are provided in each of the first row and the second row such that four respective pairs of rollers are formed.

In a preferred form, energizing the drive means drives each of the rollers in the first row or each of the rollers in the second row.

In a preferred form, energizing the drive means drives each of the rollers in the first row and each of the rollers in the second row.

In a preferred form, the method further comprises providing each of the driven rollers with an associated active gear wheel, and providing an active drivetrain coupled to the drive means and each active gear wheel.

In a preferred form, the method further comprises providing each of the non-driven rollers with an associated passive gear wheel, and providing a passive drivetrain coupled to each passive gear wheel.

In a preferred form, the method further comprises disposing the first row above the second row such that the first row is biased toward the second row by gravity.

In a preferred form, the method further comprises coupling one or more springs between the first row and the second row, wherein the one or more springs are configured to bias the first row and second row towards each other.

BRIEF DESCRIPTION OF DRAWINGS

Preferred embodiments of the invention will be described hereinafter, by way of examples only, with reference to the accompanying drawings, wherein.

DESCRIPTION OF EMBODIMENTS

Figure 1:
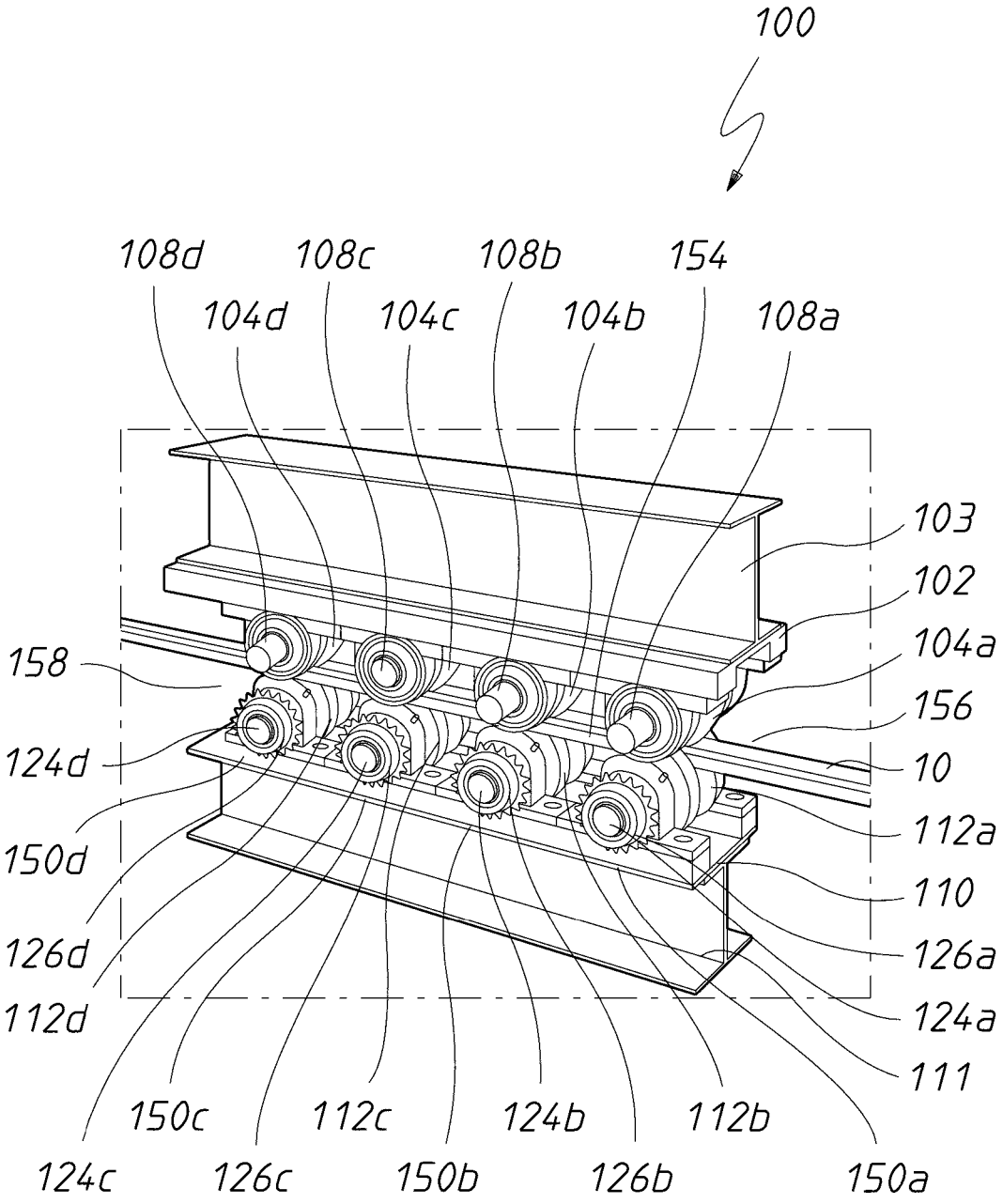
FIG. 1 is a perspective view of a three blade fence post straightening device according to a preferred embodiment with the drive means, drivetrain and frame sections removed.

FIG. 1 shows an embodiment of a three blade fence post straightening device 100. The device 100 has a first top row of rollers 102 and a second bottom row of rollers 110.

Figure 2:
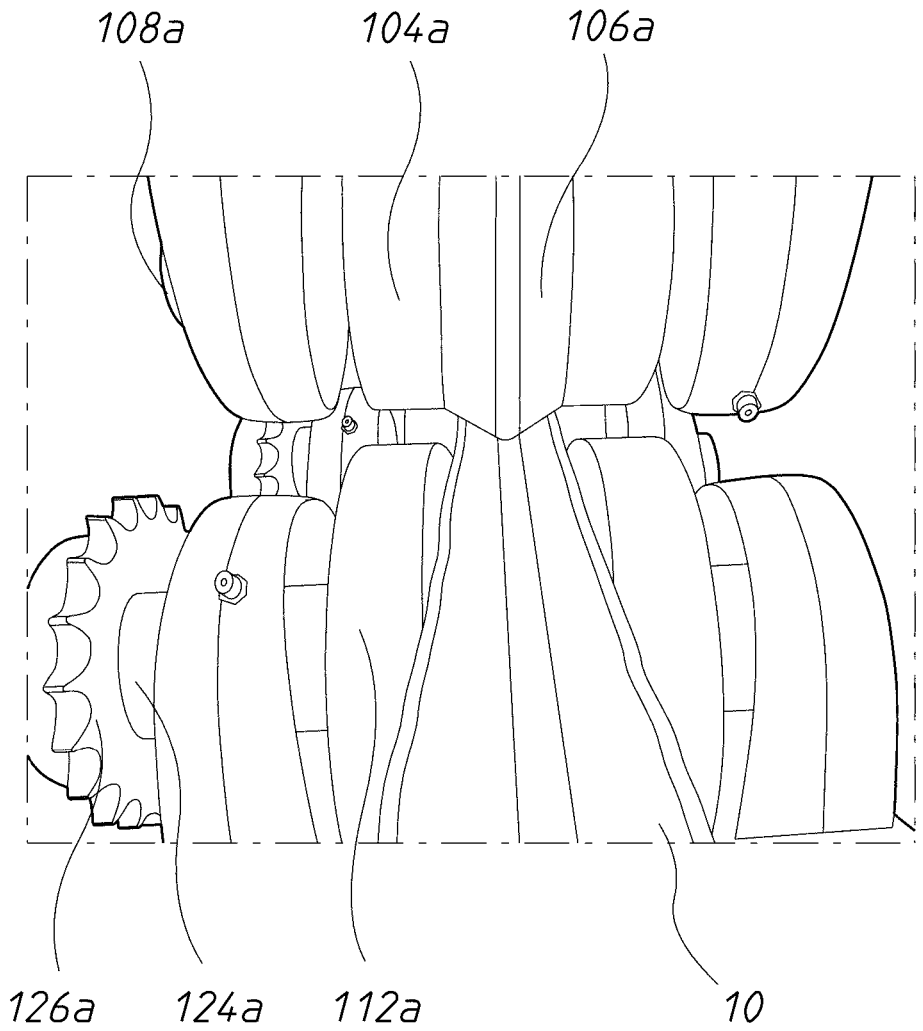
FIG. 2 is a side view of one of the rollers of the first row of rollers of the three blade fence post straightening device of FIG. 1.
Figure 3:
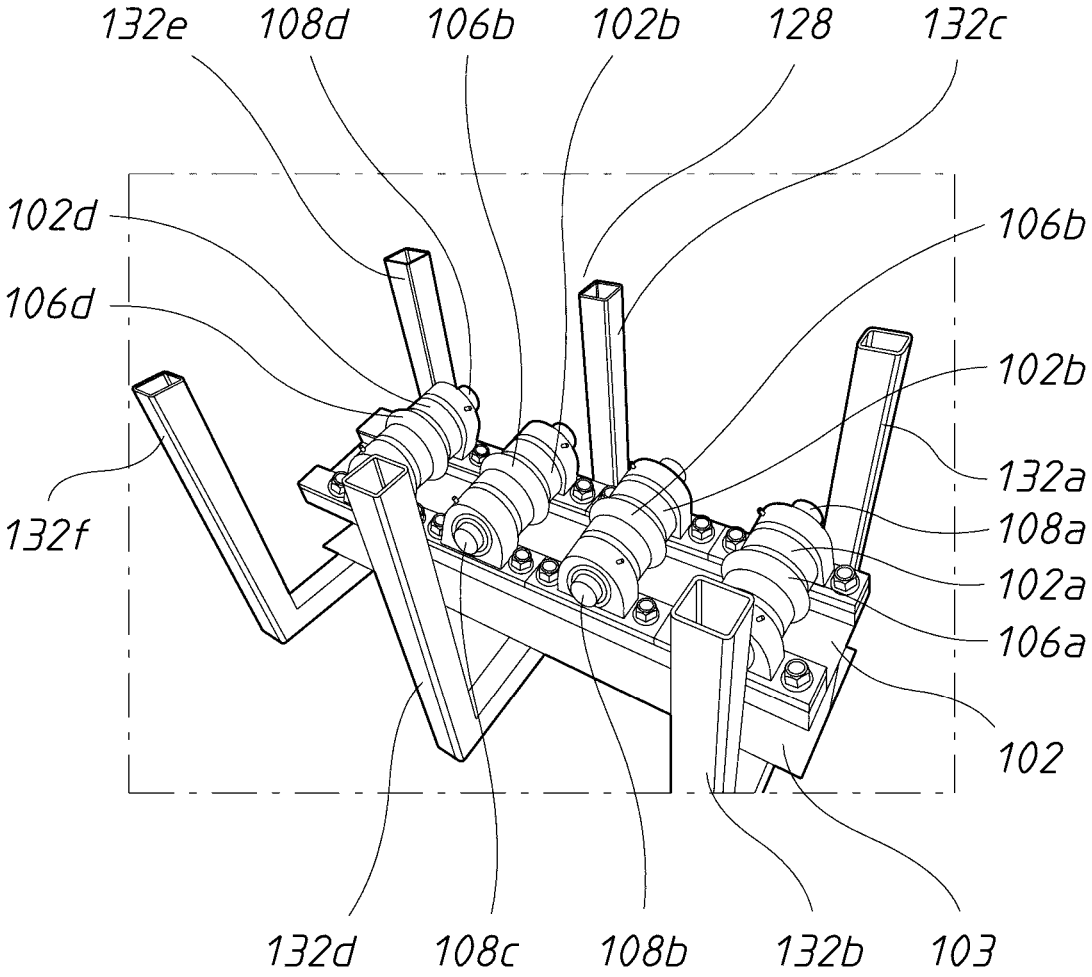
FIG. 3 is a perspective view of the first row of rollers of the three blade fence post straightening device of FIG. 1.

The first top row of rollers 102 has a top beam 103 to which is welded four rollers 104*a*-104*d*. Referring to FIGS. 2 and 3, each of the rollers 104*a*-104*d* has a respective protrusion 106*a*-106*d* extending circumferentially around the outer surface of a respective roller 104*a*-104*d*. Referring to FIG. 3, each of the rollers 104*a*-104*d* has a respective axis of rotation 108*a*-108*d*. The axes of rotation 108*a*-108*d* are all parallel to each other.

Figure 4:
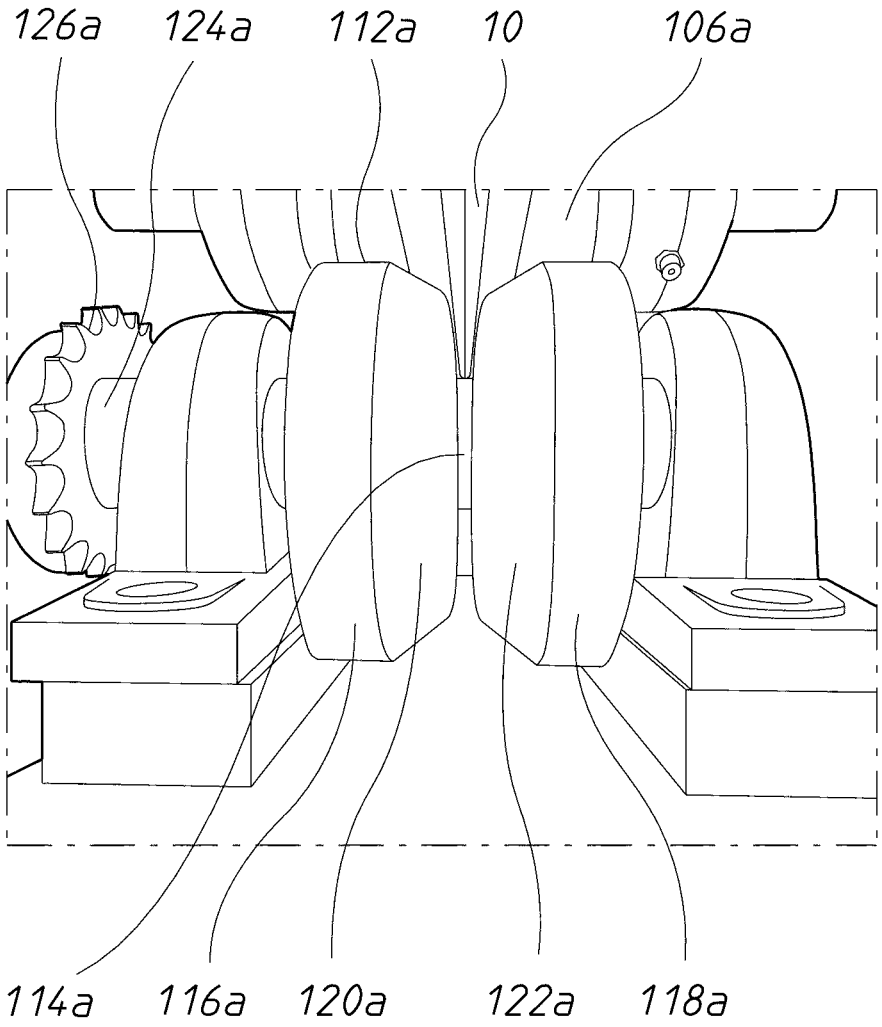
FIG. 4 is a side view of one of the rollers of the second row of rollers of the three blade fence post straightening device of FIG. 1
Figure 5:
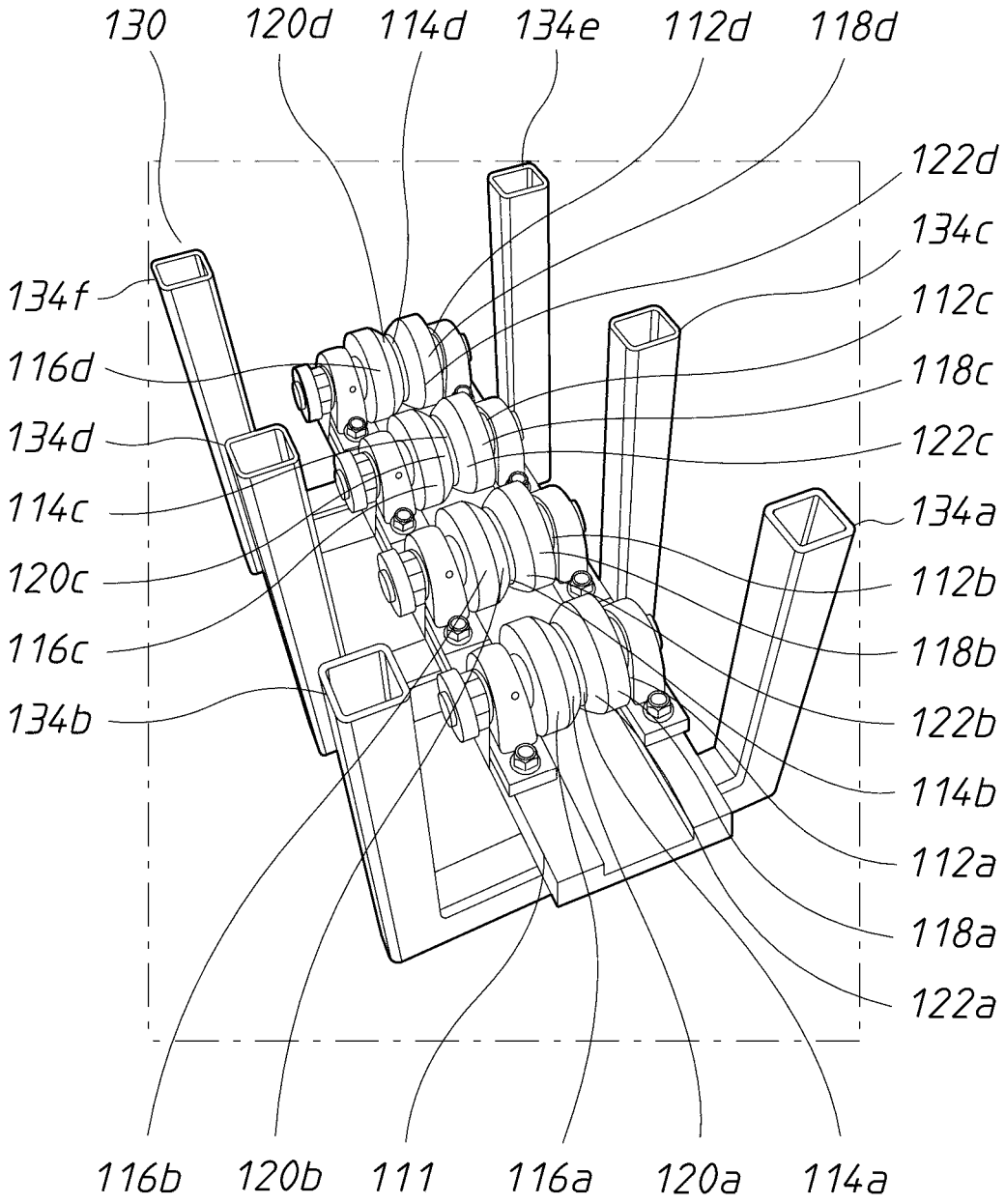
FIG. 5 is a perspective view of the second row of rollers of the three blade fence post straightening device of FIG. 1.

Referring to FIG. 1, the second bottom row of rollers 110 has a bottom beam 111 to which is welded four rollers 112*a*-112*d*. Referring to FIGS. 4 and 5, each of the rollers 112*a*-112*d* has a respective recess 114*a*-114*d* extending circumferentially around the outer surface of a respective roller 112*a*-112*d*. Each recess 114*a*-114*d* divides a respective roller 112*a*-112*d* into a respective first roller part 116*a*-116*d* and a respective second roller part 118*a*-118*d*. Each first roller part 116*a*-116*d* has a respective taper 120*a*-120*d* that tapers toward a respective recess 114*a*-114*d*, and each second roller part 118*a*-118*d* has a respective taper 122*a*-122*d* that tapers toward a respective recess 114*a*-114*d*. Referring to FIG. 5, each of the rollers 112*a*-112*d* has a respective axis of rotation 124*a*-124*d*. The axes of rotation 124*a*-124*d* are all parallel to each other. Referring to FIGS. 1 and 5, each of the rollers 112*a*-112*d* is coupled to a respective active gear wheel 126*a*-126*d*, whereby rotation of one of the active gear wheels 126*a*-126*d* results in rotation of a respective roller 112*a*-112*d*.

Figure 6:
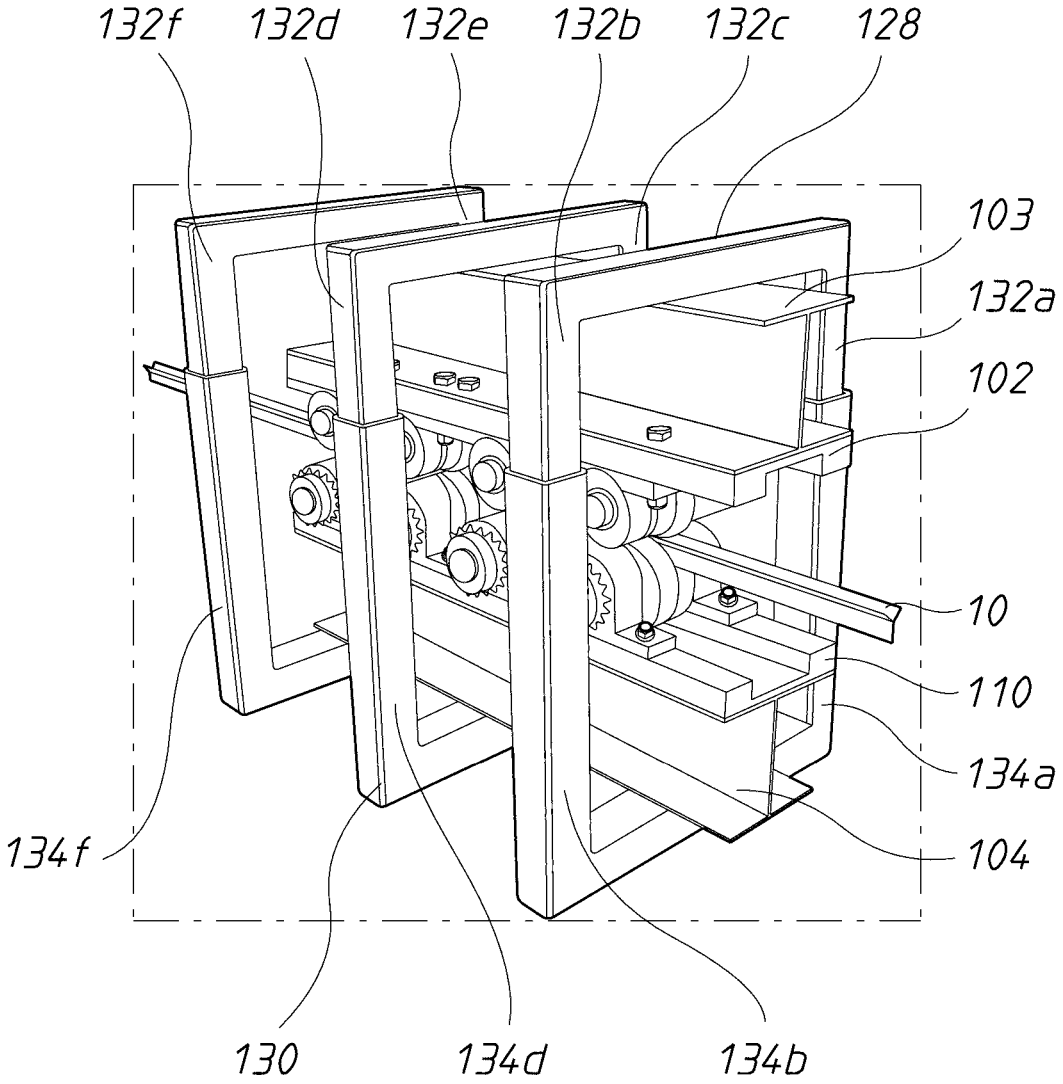
FIG. 6; is right side view of the three blade fence post straightening device of FIG. 1 with the drive means, drivetrain and frame sections installed.
Figure 7:
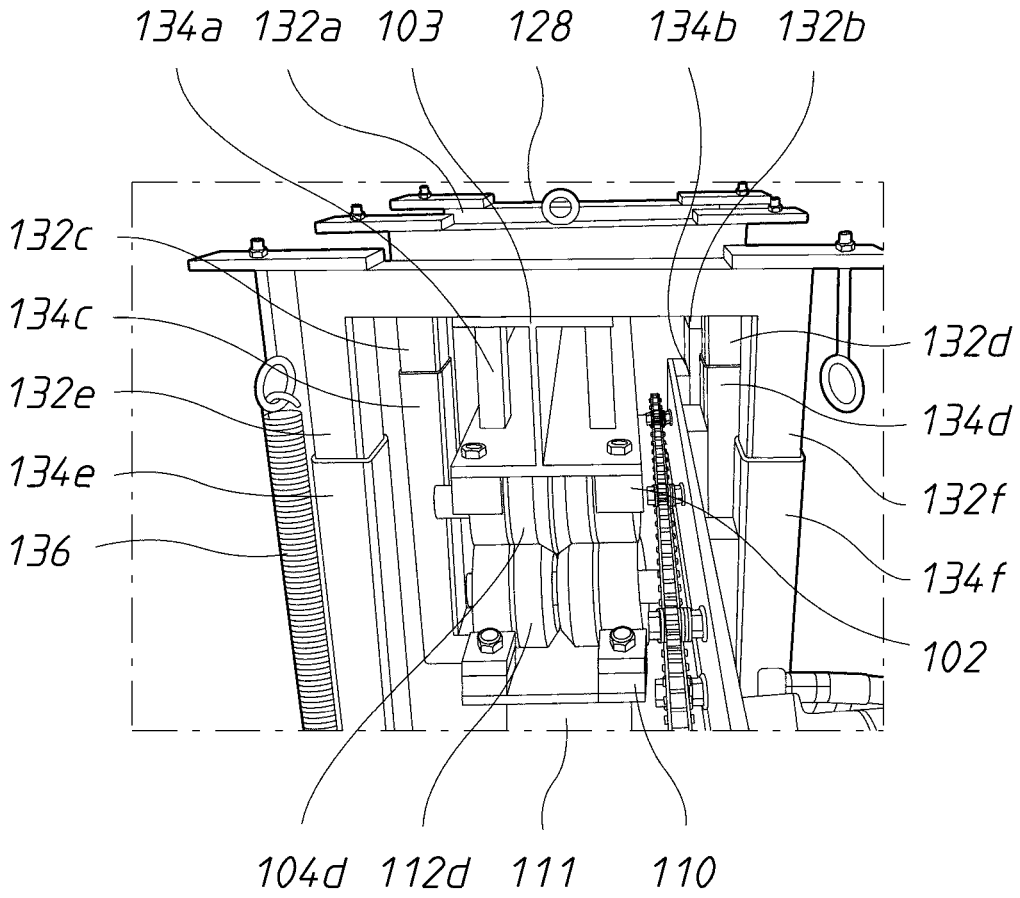
FIG. 7 is a partial left side view of the three blade fence post straightening device of FIG. 1 illustrating how the frame sections are secured to each other.
Figure 8:
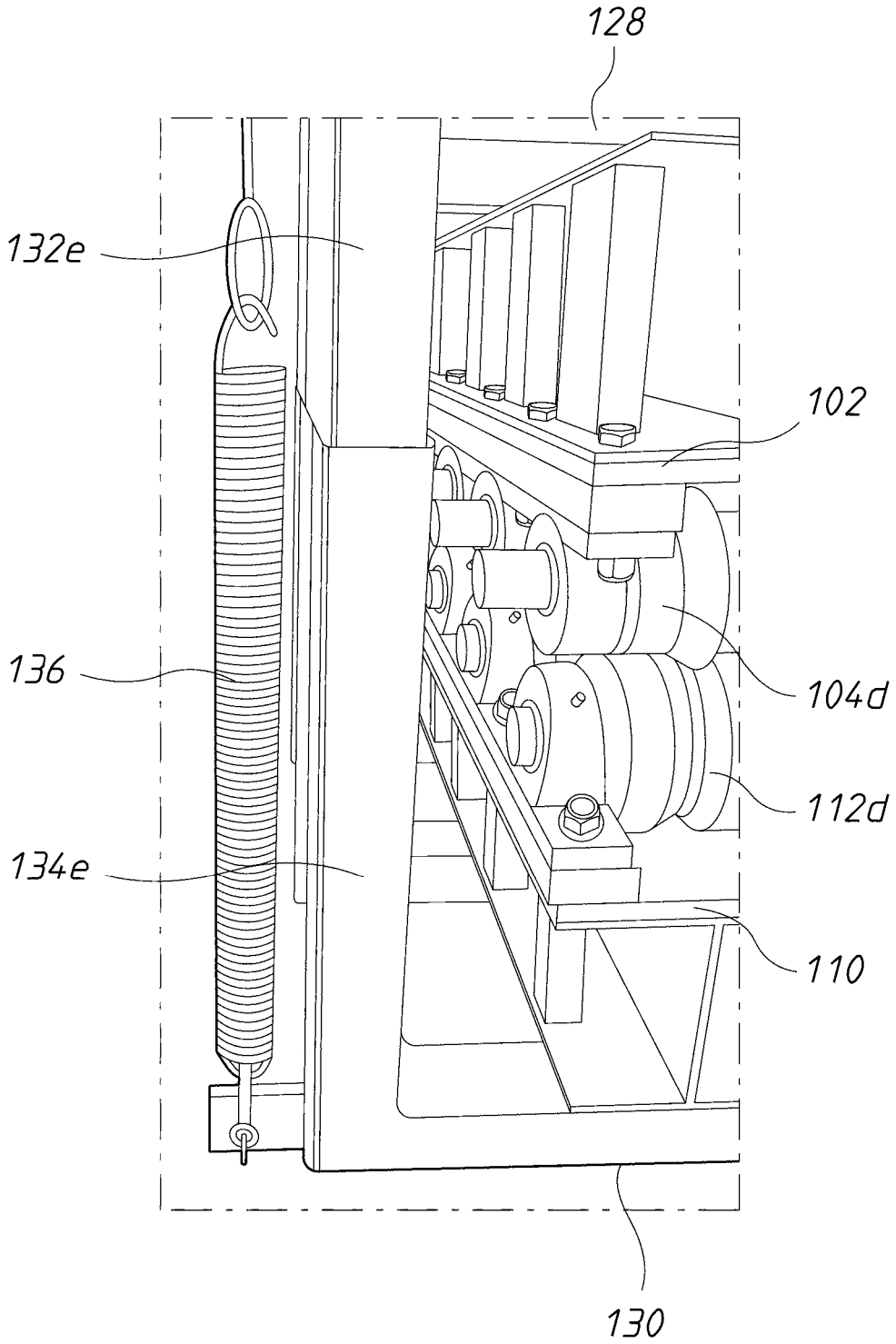
FIG. 8 is an additional partial left side view of the three blade fence post straightening device of FIG. 1 illustrating how the frame sections are secured to each other.

Referring to FIG. 6, the device 100 also has a first frame section 128 and a second frame section 130. Referring to FIG. 3, the first frame section 128 has six legs 132*a*-132*f*. Referring to FIG. 5, the second frame section 130 has six legs 134*a*-134*f*. Referring to FIGS. 7 and 8, the device 100 has six springs 136 (only one is labelled and illustrated for clarity of illustration).

Figure 9:
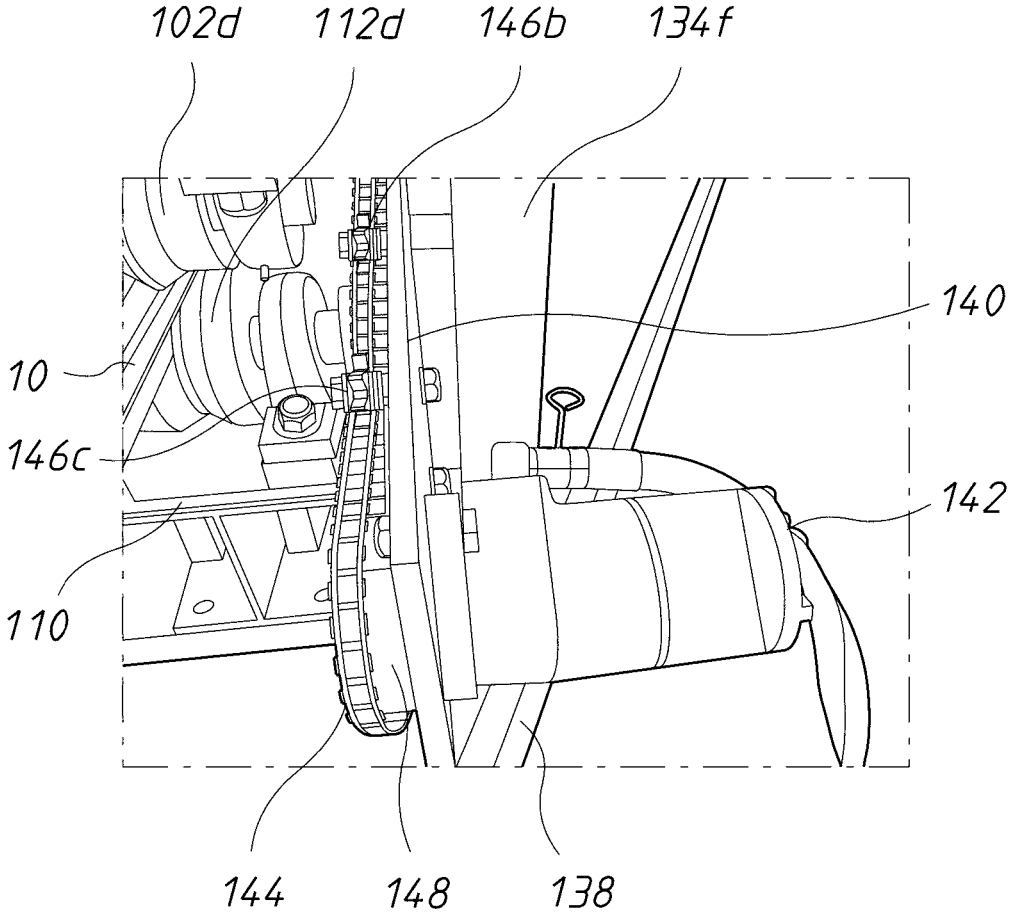
FIG. 9 shows the drive means and drivetrain installed on the three blade fence post straightening device of FIG. 1.
Figure 10:
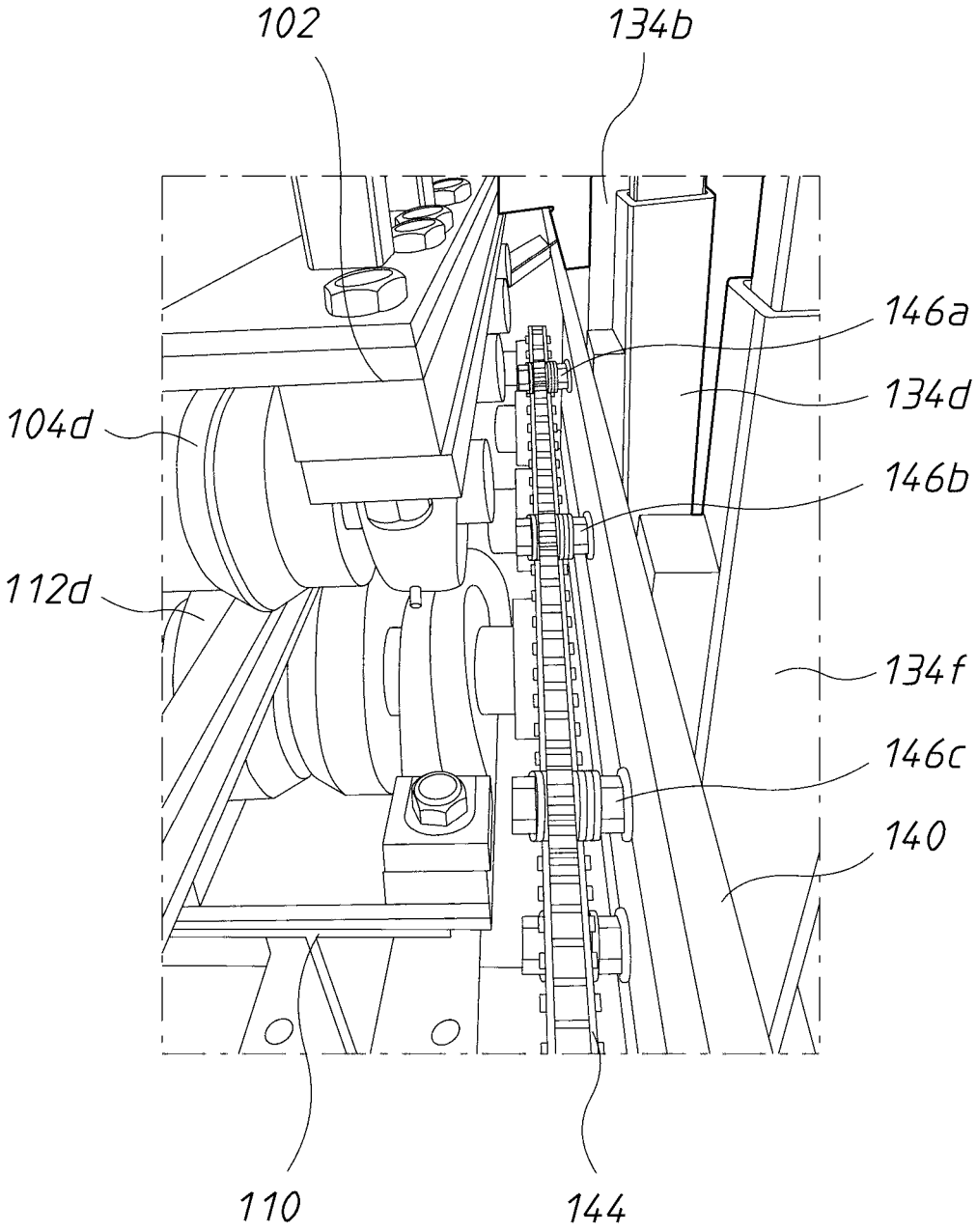
FIG. 10 is a further view of the drive means and drivetrain installed on the three blade fence post straightening device of FIG. 1.
Figure 11:
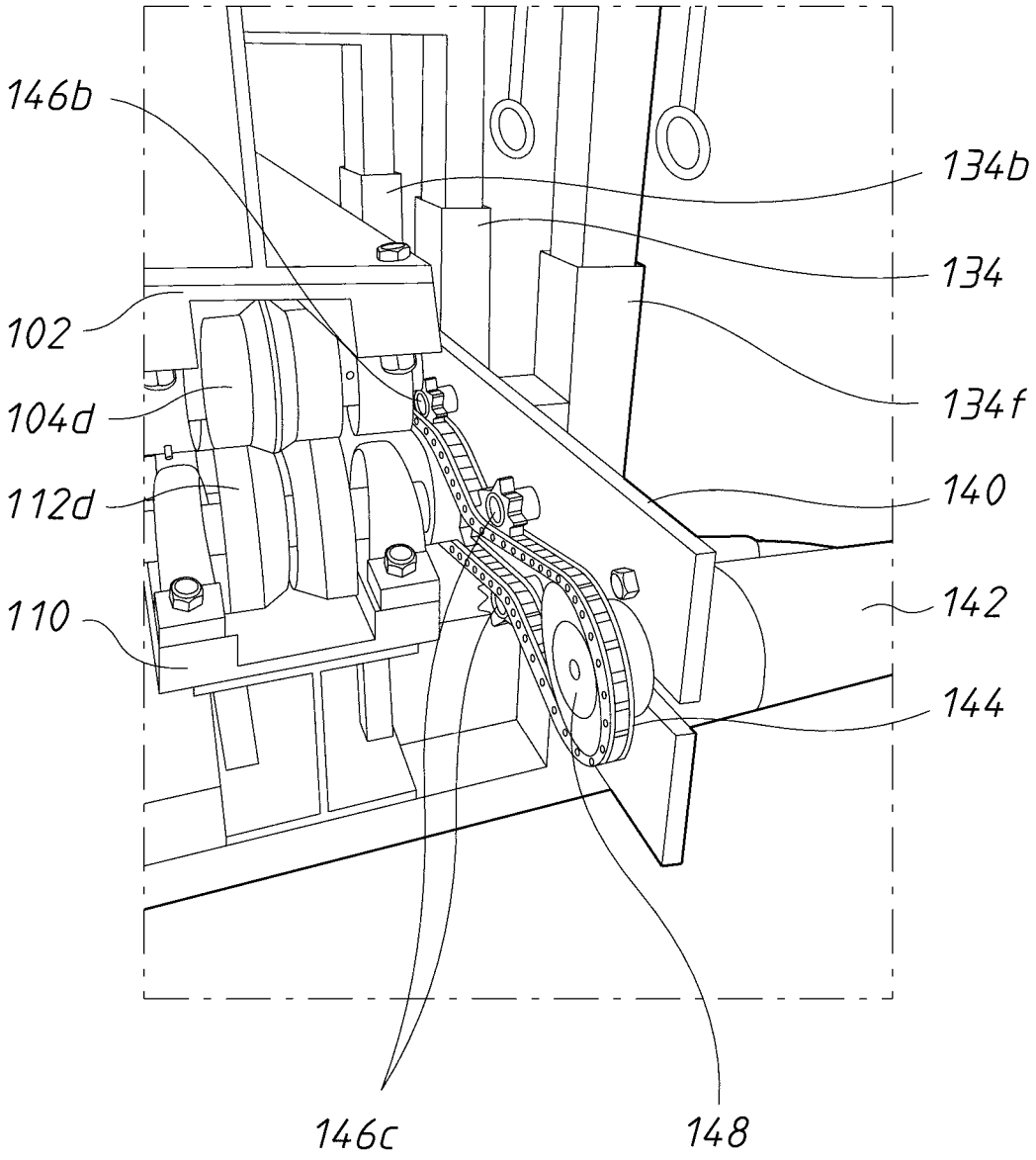
FIG. 11 is yet a further view of the drive means and drivetrain installed on the three blade fence post straightening device of FIG. 1.

Referring to FIGS. 9 to 11, the device 100 also has a drive assembly 138. The drive assembly 138 comprises a mounting plate 140, a hydraulic motor 142, a chain 144, and three pairs of tensioning gears 146*a*-146*c*. The hydraulic motor 142 has a drive gear 148, and the hydraulic motor 142 is mounted to the mounting plate 140 such that the hydraulic motor 142 is mounted on one side of the mounting plate 140 and the drive gear 148 is located on the other side of the mounting plate 140. The three pairs of tensioning gears 146*a*-146*c* are located on the same side as the drive gear 148.

Assembly of the device 100 will now be discussed. Referring to FIG. 3, the first frame section 128 is welded to the top beam 103 such that the ends of each of the legs 132*a*-132*f* project past the axes of rotation 108*a*-108*d*. Referring to FIG. 5, the second frame section 130 is welded to the bottom beam 111 such that the ends of each of the legs 134*a*-134*f* project past the axes of rotation 124*a*-124*d*.

Referring to FIG. 6, the first frame section 128 is coupled to the second frame section 130 by telescopically inserting each of the legs 132*a*-132*f* into a respective one of the legs 134*a*-134*f*. Referring to FIGS. 7 and 8, extending between the leg 132*e* and the leg 134*e* is one of the springs 136. Although not shown in the figures, a respective spring 136 also extends between the other respective leg pairs. Each of the springs 136 biases (i.e. pulls) the first frame section 128 towards the second frame section 130. The springs 136 thus secure the first frame section 128 to the second frame section 130. As will be described in more detail below, the springs 136 also assist with gripping a three blade fence post 10.

Although the first frame section 128 and second frame section 130 are not shown in FIG. 1, when the first frame section 128 is coupled to the second frame section 130, the first top row of rollers 102 opposes the second bottom row of rollers 110 thereby forming four pairs of rollers 150*a*-150*d*. Each pair of rollers 150*a*-150*d* comprises one of the rollers 104*a*-104*d* and a respective roller 112*a*-112*d*. Each axes of rotation 108*a*-108*d* is parallel to each axes of rotation 124*a*-124*d*.

Figure 12:
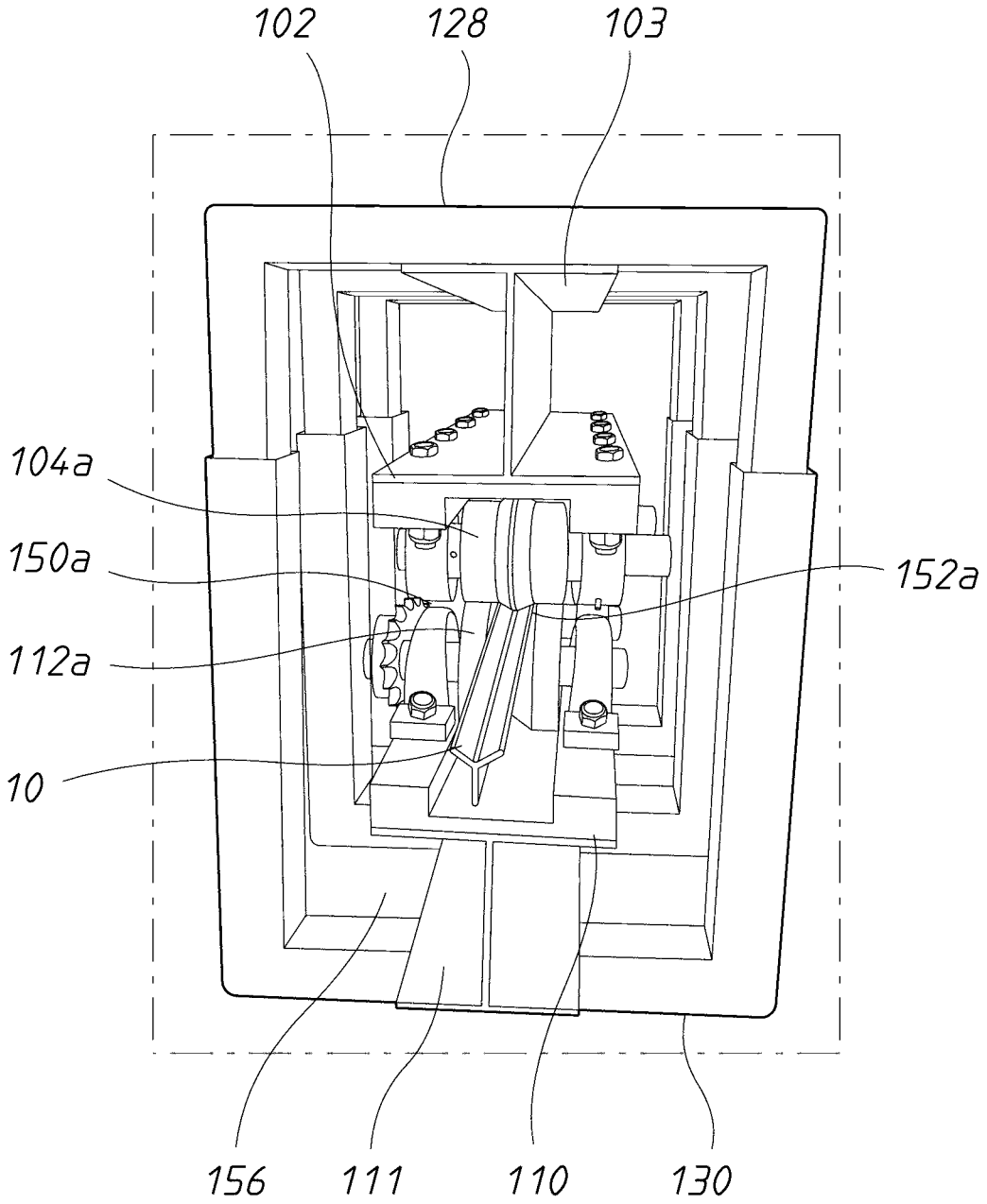
FIG. 12 shows a three blade fence post inserted between a respective pair of rollers in the three blade fence post straightening device of FIG. 1.

Although FIG. 12 only shows the pair of rollers 150*a*, it will be appreciated that outer surfaces of each pair of rollers 150*a*-150*d* define a substantially identical respective forming profile 152*a*-152*d*. Each of the forming profiles 152*a*-152*d* has a substantially "Y" shaped profile that substantially corresponds to the cross section of a three blade fence post 10. Each of the forming profiles 152*a*-152*d* are longitudinally aligned thereby forming a substantially straight path 154 through the device 100. Referring to FIG. 1, the substantially straight path 154 has a first end 156 and a longitudinally opposed second end 158. The first end 156 is defined by the pair of rollers 150*a*, and the second end 158 is defined by the pair of rollers 150*d*. It can be seen from FIG. 1, that the axes of rotation of each roller in a respective pair of rollers 150*a*-150*d* are parallel and also aligned in a direction substantially perpendicular to the substantially straight path 154. In FIG. 1, a three blade fence post 10 is positioned within the substantially straight path 154.

Referring to FIGS. 9 to 11, the mounting plate 140 of the drive assembly 138 is mounted to the legs 134*b*, 134*d* and 134*f* such that each pair of tensioning gears 146*a*-146*f* and drive gear 148 oppose the active gear wheels 126*a*-126*d*. The drive chain 144 is coupled to the drive gear 148 and each of the active gear wheels 126*a*-126*d*. Referring to FIG. 11, the drive chain 144 is installed such that is passes between each respective pair of tensioning gears 146*a*-146*c*. In use, each pair of tensioning gears 146*a*-146*c* tensions the drive chain 144, and assists in preventing the drive chain 144 from decoupling from the drive gear 148 and/or the active gear wheels 126*a*-126*d*.

Use of the device 100 will now be discussed. Energising the hydraulic motor 142 drives the drive gear 148, resulting in the drive chain 144 rotating each of the active gear wheels 126*a*-126*d* which thereby drives each of the rollers 112*a*-112*d*. Referring to FIG. 12, after the hydraulic motor 148 has been energised, a three blade fence post 10 is inserted into the first end 156 of the substantially straight path 154, and the driven rollers 112*a*-112*d* convey the three blade fence post 10 longitudinally through the substantially straight path 154 in a direction towards the second end 158 of the substantially straight path 154. Referring to FIG. 2, each of the protrusions 106*a*-106*d* are adapted to be received between two of the three blades of the three blade fence post 10. Referring to FIG. 4, each of the recesses 114*a*-114*d* are adapted to receive one of the blades of the three blade fence post 10, and respective tapers 120*a*-120*d* and 122*a*-122*d* are adapted to abut a respective blade of the three blade fence post 10.

The weight of the top beam 103 together with each of the springs 136 bias the first frame section 128 and first top row of rollers 102 towards the second frame section 130 and second bottom row of rollers 110, thereby biasing respective rollers in each pair of rollers 150*a*-150*d* towards each other. It is this biasing that results in the fence post 10 being sufficiently gripped, and conveyed, between respective rollers in each pair of rollers 150*a*-150*d* and forced through the substantially straight path 154.

As the springs 136 bias the first row of rollers 102 and second row of rollers 110 towards each other, the springs 136 also bias each roller in a respective pair of rollers 150*a*-150*d* towards each other. Accordingly, the springs 136 also assist in gripping a fence post 10 as the fence post 10 is conveyed between respective rollers in each pair of rollers 150*a*-150*d* and forced through the substantially straight path 154.

As the three blade fence post 10 is conveyed through the substantially straight path 154, the pairs of rollers 150*a*-150*d* cooperate to forcibly remove any bends in the three blade fence post 10 to substantially conform the three blade fence post 10 to the substantially straight path 154 thereby straightening the three blade fence post 10.

It is envisaged that the device 100 can be mounted to a vehicle such that the device 100 is mobile. This allows a user to drive the device 100 to a customer that requires three blade fence posts to be straightened, or to drive along fences straightening, at the location of, any bent three blade fence posts forming part of the fence.

The device 100 allows bent three blade fence posts, which would otherwise be discarded, to be straightened and reused. Straightening bent three blade fence posts using the device 100 is more cost effective than replacing bent three blade fence posts with new. It is envisaged that the device 100 can be operated to straighten bent fence posts at about one third of the cost of replacing with new fence posts. It is envisaged that the large numbers of discarded bent three blade fence posts that are otherwise simply left to rust can be straightened for reuse by using the device 100. The device 100, on average, can straighten a bent fence post in approximately five seconds.

Although the invention has been described with reference to a preferred embodiment, it will be appreciated by persons skilled in the art that the invention may be embodied in many other forms.

It is envisaged that each of the rollers 104*a*-104*d* may also be coupled to a respective passive gear wheel (not shown), whereby rotation of one of the passive gear wheels results in rotation of a respective roller 104*a*-104*d*. Further, a passive chain (not shown) may be coupled between each of the passive gear wheels such that each of the passive gear wheels, and consequently each of the rollers 104*a*-104*d*, rotate together.

The device 100 may be used to straighten three blade fence posts having a substantially "T" shaped cross-section. A three blade fence post straightening device used to straighten three blade fence posts having a substantially "T" shaped cross-section is similar to that of the device 100 described above, however, such a device would not have the protrusions 106*a*-106*d* or the tapers 122*a*-122*d* and 124*a*-124*d*. Omitting the protrusions 106*a*-106*d* and the tapers 122*a*-122*d* and 124*a*-124*d* results in a forming profile, defined between each pair of rollers, having a substantially "T" shaped cross-section.

It is also envisaged that the hydraulic motor 142 may be configured to drive each of the rollers 104*a*-104*d* and each of the rollers 112*a*-112*d*, instead of only the rollers 112*a*-112*d* described above.

Although the device 100 has been described and illustrated utilising a hydraulic motor 142, it will be appreciated that an electric motor or any other drive means known in the art may be used instead. It will also be appreciated that a drive belt or other drivetrains known in the art may be used in place of the drive chain 144 and/or passive chain.

Although the first end 156 and second end 158 of the substantially straight path 154 were described and illustrated as being defined by the pairs of rollers 150*a* and 150*d* respectively, it will be appreciated that the pair of rollers 150*d* can define the first end 156 and the pair of rollers 150*a* can define the second end 158 depending on which direction the hydraulic motor 142 is operated.

The invention claimed is:

1. A three blade fence post straightening device configured for straightening a fence post having three, equally dimensioned blades extending longitudinally of the fence post, each of which blades projects radially from a longitudinal axis of the fence post, comprising:

a first row of at least three rollers, an axis of rotation of each of the rollers in the first row being substantially parallel to each other;

a second row of at least three rollers, an axis of rotation of each of the rollers in the second row being substantially parallel to each other, the second row being disposed such that the rollers of the first and second rows oppose each other and form at least three respective pairs of rollers, with each pair of rollers comprising one of the rollers of the first row and a respective roller of the second row;

a forming profile defined between outer surfaces of the respective rollers of each pair of rollers, wherein:

each first row roller includes a protrusion that extends circumferentially around the outer surface of each of the rollers in the first row, and each of the protrusions, in use, are adapted to be received between two of the three blades of a three blade fence post, a recess extends circumferentially around the outer surface of each of the rollers in the second row, each recess divides a respective roller in the second row into a first roller part and a second roller part, and each of the recesses, in use, are adapted to receive one of the three blades of the three blade fence post, and the first roller part and the second roller part of each roller in the second row have a taper that tapers toward the recess, and, in use, respective tapers of each roller in the second row are adapted to abut two of the blades of the three blade fence post, the forming profile of each pair of rollers substantially corresponding to a cross section of the three blade fence post, with the forming profiles of each pair of rollers being longitudinally aligned to form a substantially straight path through the straightening device;

a motor configured to drive each of the rollers in the first row and/or the second row, wherein, in use, the rollers convey the three blade fence post longitudinally through the substantially straight path, and the pairs of rollers forcibly remove any bends in the three blade fence post to substantially conform the three blade fence post to the substantially straight path as the three blade fence post is conveyed through the substantially straight path.

2. The three blade fence post straightening device of claim 1, wherein the forming profiles of each pair of rollers has a substantially "Y" shaped profile.

3. The three blade fence post straightening device of claim 1, wherein the axis of rotation of each roller in a respective pair of rollers are substantially parallel and aligned in a direction substantially perpendicular to the substantially straight path.

4. The three blade fence post straightening device of claim 1, wherein the axis of rotation of each roller in the first row is substantially parallel to the axis of rotation of each roller in the second row.

5. The three blade fence post straightening device of claim 1, wherein the motor is configured to drive each of the rollers in the first row or each of the rollers in the second row.

6. The three blade fence post straightening device of claim 1, wherein the motor is configured to drive each of the rollers in the first row and each of the rollers in the second row.

7. The three blade fence post straightening device of claim 1, wherein each of the rollers driven by the motor has an associated active gear wheel, and the three blade fence post straightening device further comprises an active drivetrain coupled to the motor and each active gear wheel.

8. The three blade fence post straightening device of claim 7, wherein the active drivetrain is a chain.

9. The three blade fence post straightening device of claim 1, wherein the motor is a hydraulic motor.

10. The three blade fence post straightening device of claim 1, wherein the motor is an electric motor.

11. The three blade fence post straightening device of claim 1, wherein the first row of rollers has four rollers and the second row of rollers has four rollers, thereby forming four respective pairs of rollers.

12. The three blade fence post straightening device of claim 1, wherein the first row is disposed above the second row, and the first row is biased toward the second row by gravity.

13. The three blade fence post straightening device of claim 1, further comprising one or more springs extending between the first row and the second row, wherein the one or more springs are configured to bias the first row and the second row towards each other.

14. The three blade fence post straightening device of claim 1, wherein the three blade fence post straightening device is mounted to a vehicle.

15. The three blade fence post straightening device of claim 1, the device configured to receive a three-blade fence post wherein each blade of the three blade fence post projects radially from a longitudinal axis of the fence post.

16. The three blade fence post straightening device of claim 1, further comprising:

a first frame section coupled to the first row;

a second frame section coupled to the second row, the second frame section being in telescopic engagement with the first frame section; and at least one spring coupled to the first frame section and to the second frame section to bias the first frame section toward the second frame section.

17. A method of straightening a three blade fence post comprising three, equally dimensioned blades extending longitudinally of the fence post, each of which blades projects radially from a longitudinal axis of the fence post, the method comprising:

providing a first row of at least three rollers, an axis of rotation of each roller in the first row being substantially parallel to each other;

providing a second row of at least three rollers, an axis of rotation of each roller in the second row being substantially parallel to each other;

disposing the second row such that the second row opposes the first row and forms at least three respective pairs of rollers, each pair of rollers comprising one of the rollers in the first row and a respective roller in the second row, wherein outer surfaces of the respective rollers of each pair of rollers define a forming profile;

providing on each first row roller includes a protrusion that extends circumferentially around the outer surface of each of the rollers in the first row, and each of the protrusions, in use, are adapted to be received between two of the three blades of a three blade fence post, wherein:

a recess extends circumferentially around the outer surface of each of the rollers in the second row, each recess divides a respective roller in the second row into a first roller part and a second roller part, and each of the recesses, in use, are adapted to receive one of the three blades of the three blade fence post, and the first roller part and the second roller part of each roller in the second row have a taper that tapers toward the recess, and, in use, respective tapers of each roller in the second row are adapted to abut two of the blades of the three blade fence post, the forming profiles of each pair of rollers substantially correspond to a cross section of the three blade fence post, with the forming profiles of each pair of rollers being longitudinally aligned to form a substantially straight path, the substantially straight path having a first end and a longitudinally opposed second end;

energizing a motor configured to drive each of the rollers in the first row and/or the second row; and inserting the three blade fence post into the first end of the substantially straight path, wherein the rollers convey the three blade fence post longitudinally through the substantially straight path towards the second end, and the pairs of rollers forcibly remove any bends in the three blade fence post to substantially conform the three blade fence post to the substantially straight path as the three blade fence post is conveyed through the substantially straight path.

18. The method of claim 17, wherein four rollers are provided in each of the first row and the second row such that four respective pairs of rollers are formed.

19. The method of claim 17, wherein energizing the motor drives each of the rollers in the first row or each of the rollers in the second row.

20. The method of claim 17, wherein energizing the motor drives each of the rollers in the first row and each of the rollers in the second row.

21. The method of claim 17, wherein at least some of the rollers are driven rollers, the method further comprising providing each of the driven rollers with an associated active gear wheel, and providing an active drivetrain coupled to the motor and each active gear wheel.

22. The method of claim 17, further comprising disposing the first row above the second row such that the first row is biased toward the second row by gravity.

23. The method of claim 17, further comprising coupling one or more springs between the first row and the second row, wherein the one or more springs are configured to bias the first row and the second row towards each other.

24. The method of claim 17, further comprising:

coupling a first frame section to the first row;

coupling a second frame section to the second row, the second frame section being in telescopic engagement with the first frame section, and coupling at least one spring between the first frame section and the second frame section.

25. A fence post straightening device for straightening a fence post having three, equally dimensioned blades extending longitudinally of the fence post, each of which blades projects radially from a longitudinal axis of the fence post, the fence post straightening device comprising:

at least one first roller presenting a first outer surface and arranged for rotation about an axis thereof;

at least one second roller presenting a second outer surface and arranged for rotation about an axis thereof substantially parallel to the axis of the at least one first roller;

wherein each said at least one first roller is arranged in opposed relationship with a respective said at least one second roller to form an opposed roller pair, and wherein the first outer surface and the second outer surface of each opposed roller pair together define a forming profile there-between corresponding to a cross-section of the fence post, wherein:

each first row roller includes a protrusion that extends circumferentially around the outer surface of each of the rollers in the first row, and each of the protrusions, in use, are adapted to be received between two of the three blades of a three blade fence post, a recess extends circumferentially around the outer surface of each of the rollers in the second row, each recess divides a respective roller in the second row into a first roller part and a second roller part, and each of the recesses, in use, are adapted to receive one of the three blades of the three blade fence post, and the first roller part and the second roller part of each roller in the second row have a taper that tapers toward the recess, and, in use, respective tapers of each roller in the second row are adapted to abut two of the blades of the three blade fence post; and a motor configured to drive the at least one first roller and/or the at least one second roller in rotation about its respective axis such that, in use, the fence post is conveyed longitudinally through the forming profile of each opposed roller pair to forcibly remove any bend in the fence post and to substantially conform the fence post to the forming profile.

26. The straightening device of claim 25, wherein said at least one first roller comprises two first rollers arranged spaced apart and with their respective rotational axes substantially parallel, wherein said at least one second roller comprises two second rollers arranged spaced apart and with their respective rotational axes substantially parallel, and wherein the first and second rollers are arranged to form two opposed roller pairs.

27. The straightening device of claim 25, wherein said at least one first roller comprises three first rollers arranged spaced apart in a first row and with their respective rotational axes substantially parallel to one another, wherein said at least one second roller comprises three second rollers arranged spaced apart in a second row and with their respective rotational axes substantially parallel to one another, and wherein the first and second rollers are arranged to form three opposed roller pairs.

28. The straightening device of claim 26, wherein the forming profiles of the opposed roller pairs are substantially aligned to form a substantially straight path through the straightening device.

29. The straightening device of claim 26, wherein the forming profile of each opposed roller pair is substantially "Y"-shaped.

30. The straightening device of claim 25, further comprising:

a first frame section coupled to the first row;

a second frame section coupled to the second row, the second frame section being in telescopic engagement with the first frame section; and at least one spring coupled to the first frame section and to the second frame section to bias the first frame section toward the second frame section.

* * * * *